US006988437B2

(12) United States Patent
Granger

(10) Patent No.: US 6,988,437 B2
(45) Date of Patent: Jan. 24, 2006

(54) DEVICE FOR CONTROLLING THE ROTATION OF THE DRUM OF AN APPARATUS FOR DISPENSING WIPING MATERIAL

(76) Inventor: Maurice Granger, 17 Rue Marcel Pagnol, Saint Priest en Jarez (FR) 42270

( * ) Notice: Subject to any disclaimer, the term of this patent is extended or adjusted under 35 U.S.C. 154(b) by 116 days.

(21) Appl. No.: 10/739,806

(22) Filed: Dec. 18, 2003

(65) Prior Publication Data

US 2004/0129750 A1 Jul. 8, 2004

(30) Foreign Application Priority Data

Dec. 24, 2002 (FR) ..... 02 16814

(51) Int. Cl.
*B26D 1/62* (2006.01)
*B65H 51/04* (2006.01)

(52) U.S. Cl. ..... 83/335; 83/649; 83/949; 242/564.4

(58) Field of Classification Search ..... 83/335, 83/649, 650, 949; 242/564, 564.1, 564.2, 242/564.3, 564.4, 565, 579, 580; 226/127
See application file for complete search history.

(56) References Cited

U.S. PATENT DOCUMENTS 2,190,315 A * 2/1940 Grunwald ..... 226/200
3,777,962 A * 12/1973 Tange et al. ..... 226/129
4,712,461 A * 12/1987 Rasmussen ..... 83/334
5,868,343 A 2/1999 Granger ..... 242/564.4
6,196,102 B1 * 3/2001 Granger ..... 83/335
6,497,167 B1 * 12/2002 Granger ..... 83/337

FOREIGN PATENT DOCUMENTS

FR 2 743 057 7/1997

* cited by examiner

*Primary Examiner*—Allan N. Shoap

*Assistant Examiner*—Edward Landrum

(74) *Attorney, Agent, or Firm*—Heslin Rothenberg Farley & Mesiti P.C.

(57) ABSTRACT

This device for controlling the rotation of the drum in an apparatus for dispensing wiping material being arranged with a profiled lever articulated at its base against the action of an elastic return means. The lever is arranged in the upper part with a support spindle for a pair of pulleys that are mounted to rotate freely. The lever is arranged to be articulated at its base by two spindles arranged in an angular sector concentric with the point and with the spindle of articulation of the drum. The end plate housing the drum is arranged with two oblong slots formed in sectors concentric with the opening and region of housing of the spindle of the drum. The spindles are introduced into and guided in said slots and an upper end of the lever protrudes beyond the upper edge face of the end plate holding the roll, while at the same time facing the outer wall thereof.

8 Claims, 5 Drawing Sheets

DEVICE FOR CONTROLLING THE ROTATION OF THE DRUM OF AN APPARATUS FOR DISPENSING WIPING MATERIAL

The invention relates to the technical field of apparatuses for dispensing wiping paper made of cellulose wadding, crepe paper or similar materials intended more especially for wiping user's hands, dispensing toilet paper, and dispensing paper towels.

The applicant has developed and optimized a device for controlling the rotation of the drum in an apparatus for dispensing wiping material the characteristics of which are defined in French patent No. 2743057.

A brief recollection of the design of the aforementioned apparatus will be given, on the basis of FIG. 1, so as to demonstrate and expose the disadvantages related thereto in order to culminate in the subject of the invention.

The dispensing apparatus (1) comprises a casing (2), a cover (3), a drum (4), a copying device (5) built into the drum, a pressing element (6) and means for starting and returning the drum including an eccentric (7) and a spring (8). In its upper part, the casing has two end plates (2*a*) able to accommodate a roll holder (9) or support end fittings for feeding a roll (B) of wiping material.

The drum (4) and the pressing element are also held between end plates (2*c*) formed at right angles to the rear plane of the casing. The drum comprises a spindle extended at its ends to form, on the one hand, an operating knob, and, on the other hand, beyond the receiving end plate, the eccentric lever (7) able to accommodate the start and return spring (8). The assembly comprising the drum (4) and the pressing element (6) allows the web of paper to pass behind and be driven behind the drum so that it can be cut, the pressing element resting against the drum and the assembly rotating in the manner of gearing in the opposite direction.

A follower cylinder roller (10) is arranged in the bottom part of the casing and its purpose in particular, in a known way, is to protect the user's hands by being situated where the paper leaves the apparatus and to guide the paper as it leaves.

The device (12) for controlling rotation of the roll which device is claimed in patent FR 2743057 essentially comprises a cranked lever articulated at its base by its short flange (12*a*) to the lower end plate (2*c*) supporting the drum and presser roller. This lever is articulated to a spindle (11) fixed to the casing against the action of an elastic return means (13) one end (13*a*) of which is fixed in the cranked inner part (12*b*) of the lever and the other end (13*b*) of which is fixed to the front of the end plate (2*c*). At the upper end (12*c*) of its arm (12*d*) the lever is arranged directly by casting with a support spindle (14) the two pulleys or rollers (15 and 16) mounted to rotate freely on the support spindle. A small-diameter first pulley (15) is able to lie in the plane of a groove (4*b*) formed on a cheek (4*c*) attached to the facing end of the drum (4) to take a drive and connecting belt (17). The second pulley or roller (16) has a groove (16*a*) able to take a snap ring (18) constituting a means that creates friction with the roll of material. This second pulley (16) is able to come to rest from behind against the roll of material (B) thus providing braking contact. The two pulleys (15–16) are fastened by wedges onto the same spindle and therefore driven in rotation simultaneously.

The roll of material when offered up into the apparatus urges the lever (12) via its pulley (16) and drives the backwards tilting of the said lever against the action of the aforementioned elastic return means (13). The travel of the lever is therefore established over a certain distance corresponding at least to the initial diameter of the roll to be functional from the time of its installation until this roll is used up. The pulley (16) forming a follower roller is always in contact with the roll of material because of the return effect of the elastic means. Advantageously, a projecting abutment point (12*e*) is formed on the upper edge face of the lever for coming into abutment with the upper part of the end plate (2*c*).

The device for controlling the rotation of the drum thus described operates satisfactorily under normal conditions of use and on pulling of the web of material by the user.

However, in practice, it has been found that the device was insufficient in at least two specific situations.

First of all, the spindle (11) for the articulation of the lever (12) lies in a different plane from the rotation spindle of the drum (4) which means that the drive belt (17) is too taut when the roll of wiping material is of small diameter. There is then a risk of damage to the apparatus.

Furthermore, the control device (12) in the form of a cranked lever has a certain flexibility and, in the embodiment of the invention according to patent FR 2743057, the length of its arm (12*d*) is such that it positions itself under the facing edge face of the end plate (2*a*) supporting the roll holder.

Now, it can happen that, because of its weakness and its ability to flex sideways, the said lever is made to move sideways within the casing between the roll-holder end plates or beyond, on the outside of these end plates, putting the apparatus out of service. This phenomenon is due either to excessive pulling operations on the web of material by users and often by oblique pulling. However, it can occur when the apparatus is being loaded by the maintenance personnel. It should be remembered that this type of apparatus is situated in public places and that the maintenance personnel are often independent of the maintenance departments of the company that manufactures the apparatuses. There is not always the required care taken, which means that brakedowns may occur for reasons of this kind.

There is therefore a need to seek to optimize the construction of the apparatus with the best possible reliability with regards to the existing user constraints.

The desired goal according to the invention is therefore to overcome these disadvantages and to find a solution able to address the problems posed.

According to a first feature, the device for controlling the rotation of a drum in an apparatus for dispensing wiping material of the type comprising a casing, a cover, a drum, a cutting device built into the drum, a pressing element and means for starting and returning the drum including an eccentric and a spring, in its upper part, the casing accommodating two end plates able to house a roll of wiping material, the said drum and the pressing element being held between end plates produced at right angles to the back plane of the casing, the device for controlling the rotation of the drum being arranged with a profiled lever articulated at its base against the action of an elastic return means, the said lever being arranged in its upper part with a support spindle for a pair of pulleys that are mounted to rotate freely, is a device characterized in that it is arranged in the form of a lever arranged to be articulated at its base by two spindles arranged in an angular sector concentric with the point and with the spindle of articulation of the drum, and in that the end plate housing the drum is arranged with two oblong slots formed in sectors concentric with the opening and region of housing of the spindle of the drum, and in that the said spindles are introduced into and guided in said slots and in that the upper end of the lever protrudes beyond the upper edge face of the end plate holding the roll, while at the same time facing the outer wall thereof.

These characteristics and others still will become clearly apparent from the remainder of the description.

In order to set its subject, the invention is illustrated non-limitingly in the figures of the drawings in which.

In order to make the subject of the invention more concrete, it is now described in a non-limiting manner illustrated in the figures of the drawings.

With regards to the earlier description of the apparatus in terms of its main components and in terms of the device controlling the rotation of the drum, the remainder of the present description will relate only to the improvements made to the said device, the same references being kept for things which are identical to those described in French Patent No. 2743037.

Thus, according to the invention, the device for controlling the rotation of the drum is produced in its improved form in the form of a lever referenced (20). It is arranged to be articulated at its base (20*a*) by two spindles (20*b*) (20*c*) arranged in an angular sector concentric with the point and spindle (4*a*) of articulation of the drum (4) by a special arrangement of the lower end plate (2*c*) formed on the casing of the apparatus. Furthermore, the said lever (20) is very long so that its upper end (20*d*) extends beyond the lower edge face of the roll holder end plate (2*a*) preventing, in this embodiment, any flexibility and overhang of the lever into the volume of the casing of the apparatus accommodating the roll of material, or outwards.

Figure 1:
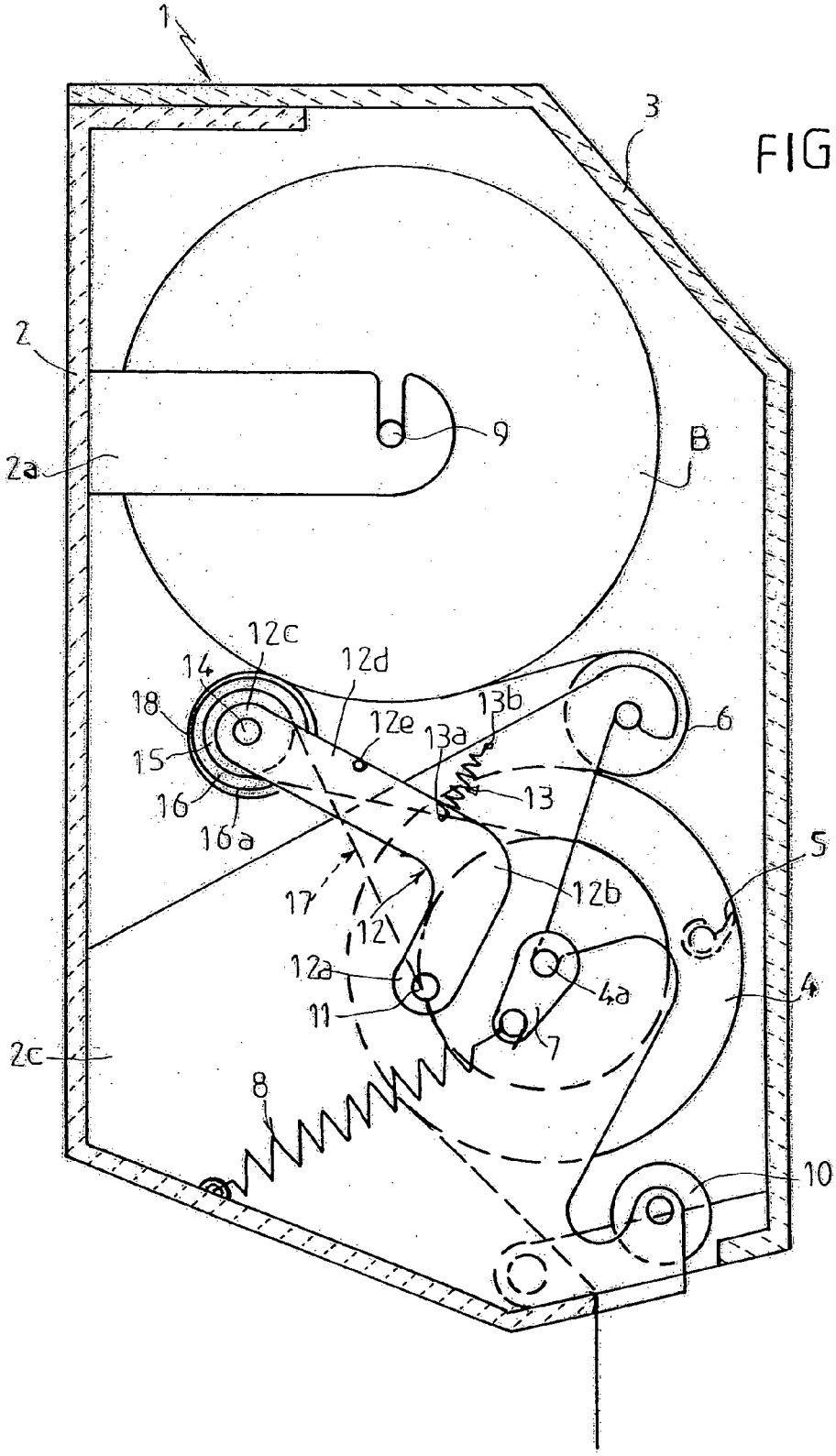
FIG.1 PRIOR ART
FIG. 1 is a sideview of the wiping material dispensing apparatus equipped with the device for controlling the rotation of the drum and defined according to patent FR 2743057.
Figure 2:
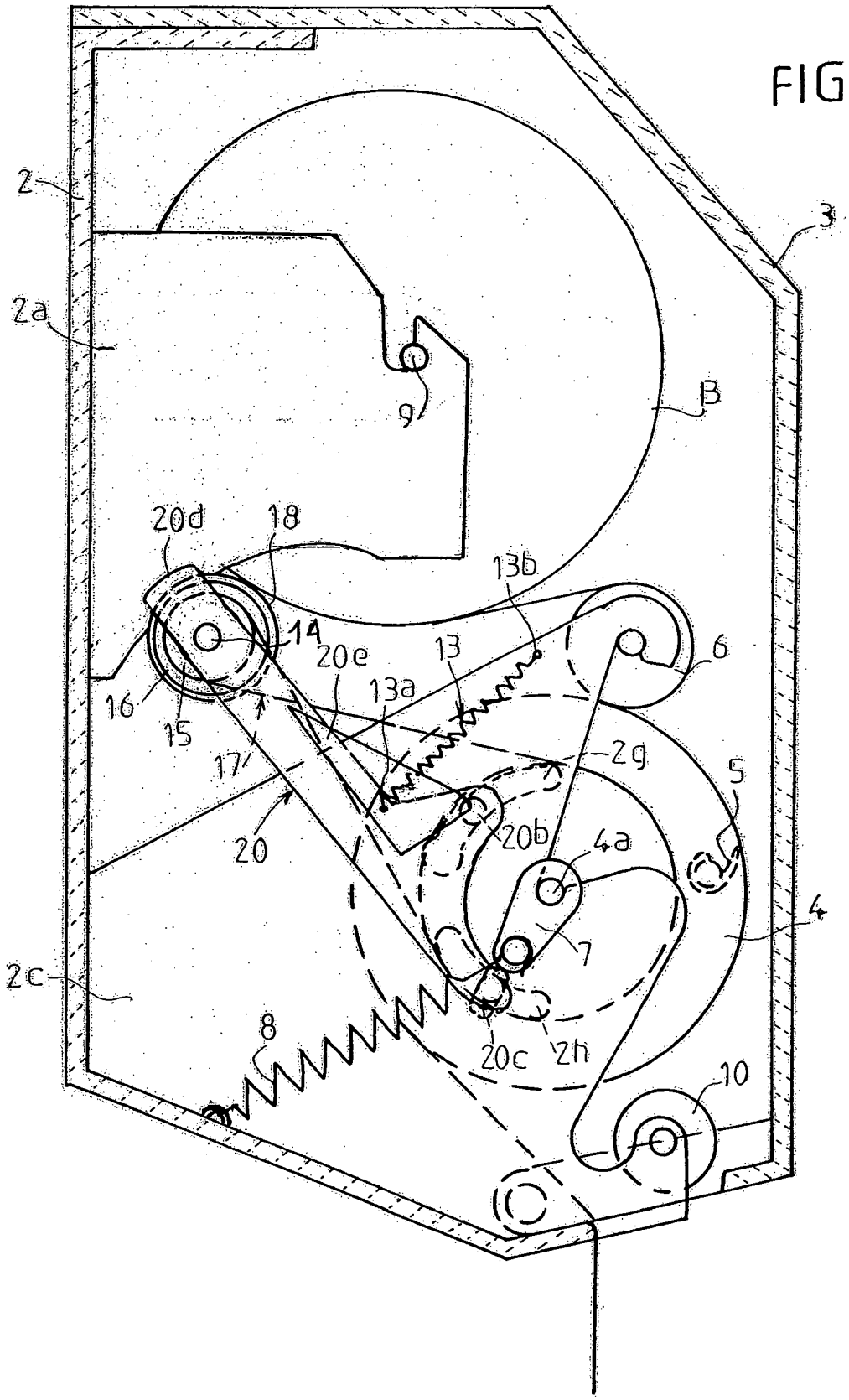
FIG. 2 is a sideview of the wiping material dispensing apparatus equipped with the improvements made to the device for controlling the rotation.
Figure 3:
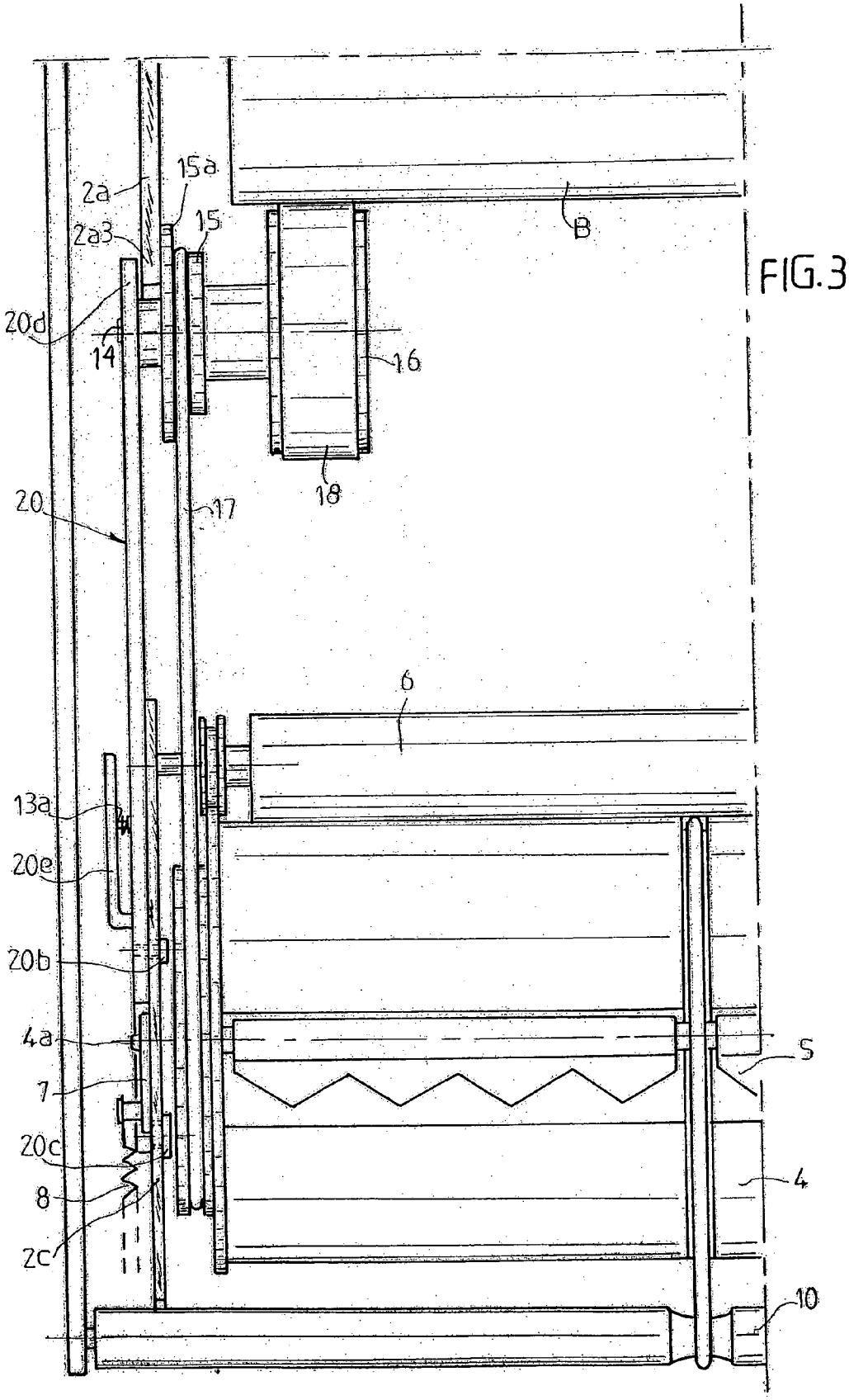
FIG. 3 is a front view on FIG. 2, halved.
Figure 4:
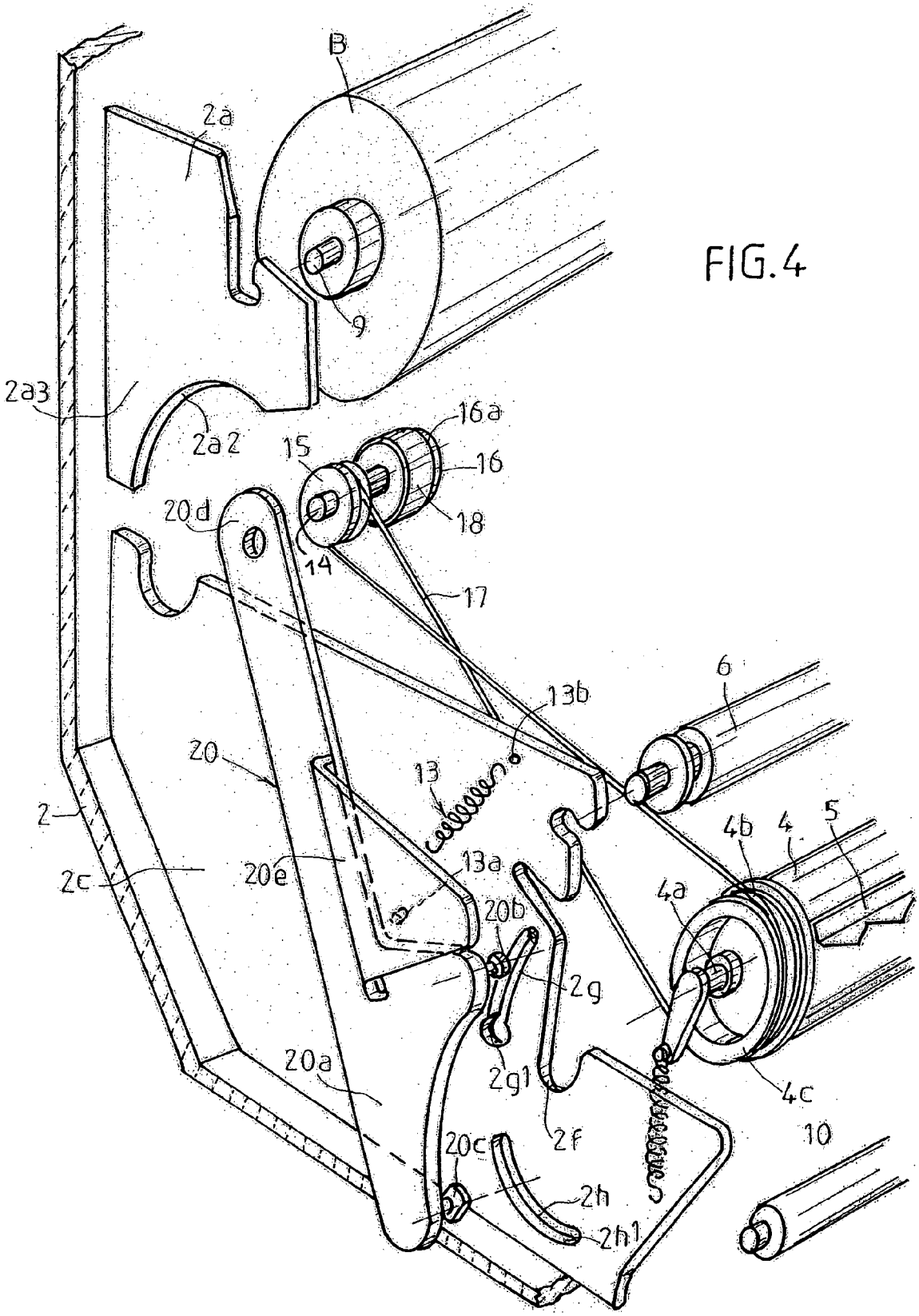
FIG. 4 is a perspective view prior to mounting illustrating in particular improved control device according to the invention.
Figure 5:
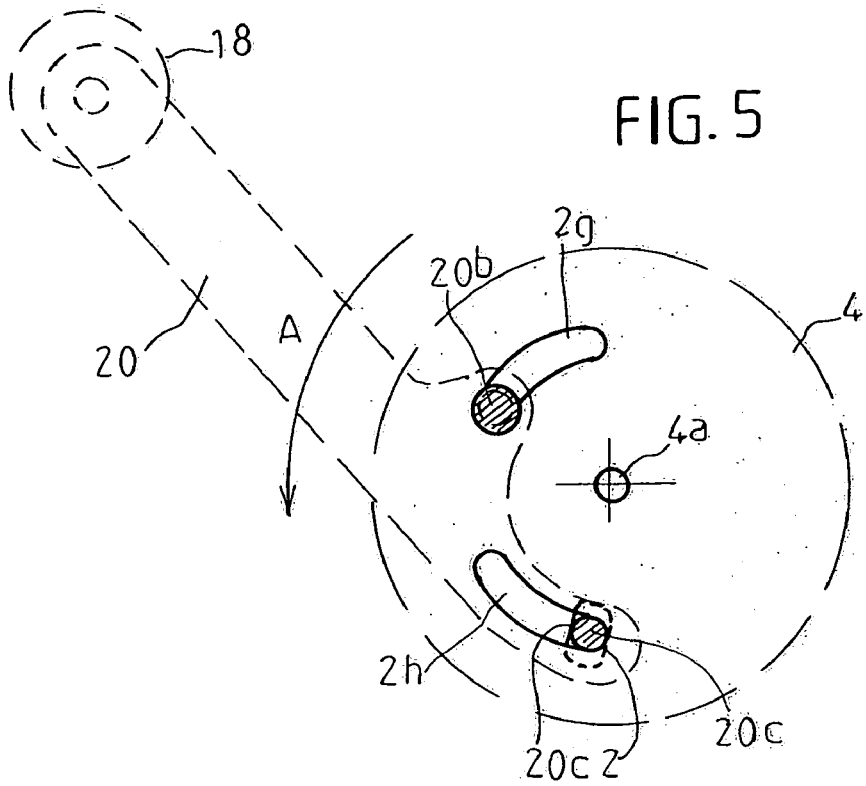
FIGS. 5 and 6 are part views illustrating the installation of the control device on the casing.
Figure 6:
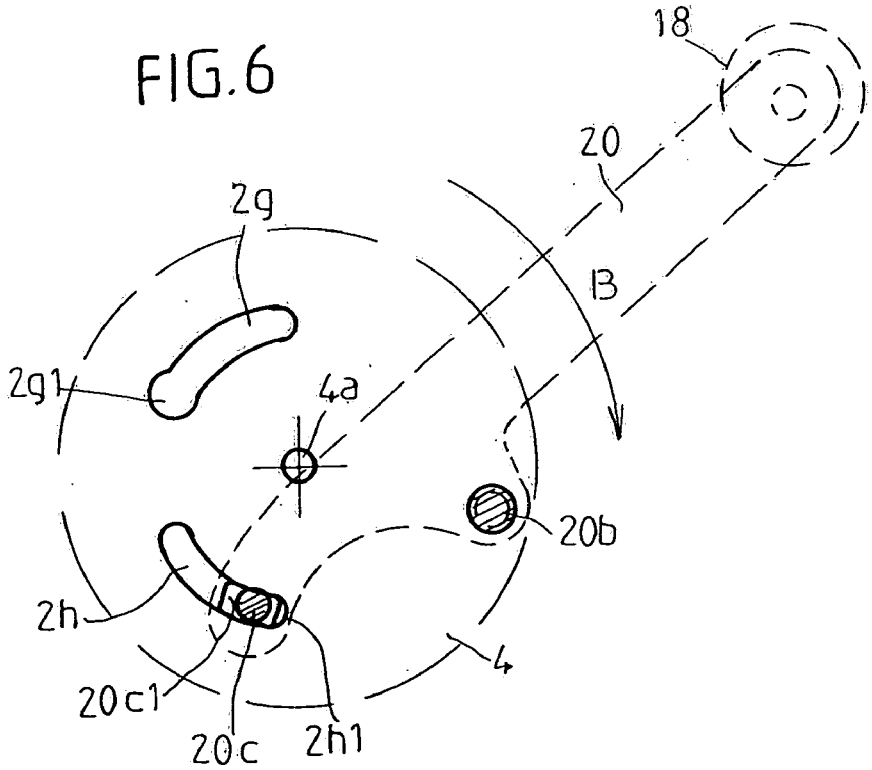

Thus, with reference to FIGS. 3, 4 and 5 in particular, the lever (20) has a lower base (20*a*) with a configuration in the shape of an arc of a circle over an angular sector of the order of 90° and arranged concentrically with the positioning of the spindle (4*a*) of the drum (4) and of the region (2*f*) of the end plate (2*a*) that accommodates the aforementioned spindle (4*a*).

This configuration in the shape of an arc of a circle is such that the lever (20) is arranged near its ends with two spindles (20*b*) (20*c*) with head which are formed integrally and are able to engage and move in two oblong slots (2*g*–2*h*) formed on the end plate (2*c*) and also arranged in sectors concentric with the opening and with the region (2*f*) housing the spindle of the drum. One (2*g*) of these two sectors (2*g*–2*h*) lies in an upper plane of the region (2*f*) and the other, (2*h*), lies in a lower plane.

Each sector (2*g*–2*h*) has, at one end, a widened region (2*g*1–2*h*1) to allow the passage of the stepped spindles (20*b*–20*c*) with heads so that these spindles can then come for guidance into the oblong sectors. It should be noted, that according to a particular arrangement of the invention, the head (20*b*1) of the spindle (20*b*) is cylindrical and fits into and is guided in the upper angular sector, while the head (20*c*1) of the spindle (20*c*) has two parallel flats (20*c*2) to lock the lever device (20) in position once it has been introduced into and pivoted in the lower sector (2*h*). Thus, through such an arrangement and after the spindles (20*b*–20*c*) have put in position, the lever (20) is locked in position and its angular excursion is defined and limited by the oblong sectors (2*g*–2*h*).

The lever (20) also has, in its lower part, a region in the form of a lug (20*e*) appreciably offset with respect to the base plane of the lever and which receives the point of attachment of one of the ends (13*a*) of the lever return spring (13), the other end (13*b*) being fixed to the end plate (2*c*) of the casing. The said lug (20*e*) has a bracket-shaped profile and essentially serves to protect the aforementioned spring.

In its upper part the lever (20) is very long and its upper end (20*d*) projects beyond the edge face (2*a*2) of the end plate (2*a*) supporting the roll holder. The said upper end (20*d*) thus faces the outer face of the end plate (2*a*3) opposite so that it is impossible for the lever (20) to move or flex. The end plate (2*a*) opposite is arranged with the upper end (20*d*) of the said lever (20) on one side and with the outer cheek (15*a*) of the pulley (15) that takes the drive belt (17) on the other side.

The improved device according to the invention perfectly addresses the problems posed.

Because the lever (20) rotates about the spindle (4*a*) of rotation of the drum (4), the drive belt tension (17) is always constant. There is no chance that the lever (20) will move sideways inside the volume of the casing or outside the latter, because the lever (20) on account of its long length and supporting the spindle (14) that takes the belt drive pulleys (15–16) and the snap ring (18) for driving the roll of material sandwiches the end plate (2*c*) that accommodates the roll holder.

As a side issue, the novel arrangement avoids the occasional initial annoyance of the exiting of the roll at the end of the roller and of the latter's cardboard tube.

The lever according to the invention is easy to mount. With reference to FIGS. 4 and 5, the user has to orientate the lever in the direction of the arrow A (FIG. 4) so as to bring the spindles (20*b*) (20*c*) into the widened parts (2*g*1) (2*g*2) of the two sectors (2*g*–2*h*).

The lever is then disengaged from the uppermost point, that is to say by disengaging the circular head of the spindle (20*b*) from the sector. Then, in a reverse movement (FIG. 5) the lever is pivoted in the direction of the arrow (B) so that the flatted parts (20*c*2) of the head (20*c*) can align with the opening formed at this point on the sector and allow the assembly to be disengaged.

The return spring (13) returning the lever (20) is also removed.

The advantages are clearly apparent from the invention. Emphasis is placed on the new reliability of the device which offers better reliability of the use of the apparatus.

The invention claimed is:

1. Device for controlling rotation of a drum in an apparatus for dispensing wiping material of a type comprising a casing, a cover, a drum, a cutting device built into the drum, a pressing element and means for starting and returning the drum including an eccentric and a spring, in its upper part, the casing accommodating two end plates able to house a roll of wiping material, the drum and the pressing element being held between end plates produced at right angles to a back plane of the casing, the device for controlling the rotation of the drum being arranged with a profiled lever articulated at its base against action of an elastic return means, said lever being arranged in the upper part with a support spindle for a pair of pulleys that are mounted to rotate freely, wherein the lever is arranged to be articulated at its base by two spindles arranged in an angular sector concentric with a point and with a spindle of articulation of the drum, an and end plate housing the drum is arranged with two oblong slots formed in sectors concentric with an opening and region of housing of the spindle of the drum, and said two spindles are introduced into and guided in said slots and an upper end of the lever protrudes beyond an upper edge face of an end plate holding the roll, while at the same time facing an outer wall thereof.

2. Device according to claim 1, wherein the base of the lever has a configuration in the shape of an arc of a circle in an angular sector of the order of 90° arranged concentrically with the positioning of the spindle of the drum and of the region receiving the spindle, and one of the slots in the form of sectors lies situated in an upper plane of said region and the other lies situated in a lower plane.

3. Device according to claim 1, wherein each sector has a widened region to allow the passage of the spindles of the lever which are guided in the oblong slots.

4. Device according to claim 3, wherein a head of a first spindle of the two spindles is cylindrical and fixed such that it can be guided in the upper angular sector, and a head of a second spindle of the two spindles has two parallel flats to lock the lever in position once it has been introduced into and pivoted in the lower sector.

5. Device according to claim 1, wherein the lever has, in its lower part, a lug-shaped region offset with respect to a base plane of the lever and accommodating a fixing point for one of ends of the elastic return means of the lever, the other end being fixed to the end plate of the casing.

6. Device according to claim 1, wherein the upper end of the lever extends beyond the edge face of the end plate supporting the roll holder, the end plate finding itself arranged with, on one side, the upper end of the lever and, on the other side, an outer cheek of a first pulley of the pair of pulleys that takes the drive belt.

7. Device according to claim 2 wherein each sector has a widened region to allow passage of the spindles of the lever which are guided in the oblong slots.

8. Device according to claim 7, wherein a head of a first spindle of the two spindles is cylindrical and fixed such that it can be guided in the upper angular sector, and a head of a second spindle of the two spindles has two parallel flats to lock the lever in position once it has been introduced into and pivoted in the lower sector.

* * * * *

UNITED STATES PATENT AND TRADEMARK OFFICE

CERTIFICATE OF CORRECTION

PATENT NO. : 6,988,437 B2
DATED : January 24, 2006
INVENTOR(S) : Granger

It is certified that error appears in the above-identified patent and that said Letters Patent is hereby corrected as shown below:

Column 5,
Line 4, delete "an and" and insert -- and an --.

Signed and Sealed this

Second Day of May, 2006

JON W. DUDAS
*Director of the United States Patent and Trademark Office*